US007171831B2

(12) United States Patent
Matthews

(10) Patent No.: US 7,171,831 B2
(45) Date of Patent: Feb. 6, 2007

(54) TOOL FOR TURNING KEYS

(76) Inventor: Stephen N. Matthews, 8 Eversley Crescent Winchmore Hill, London N21 1EJ (GB)

( * ) Notice: Subject to any disclaimer, the term of this patent is extended or adjusted under 35 U.S.C. 154(b) by 0 days.

(21) Appl. No.: 10/493,966

(22) PCT Filed: Oct. 30, 2002

(86) PCT No.: PCT/GB02/04881

§ 371 (c)(1),
(2), (4) Date: Oct. 5, 2004

(87) PCT Pub. No.: WO03/038215

PCT Pub. Date: May 8, 2003

(65) Prior Publication Data

US 2005/0039505 A1 Feb. 24, 2005

(30) Foreign Application Priority Data

Oct. 30, 2001 (GB) ..... 0125956.3
Mar. 22, 2002 (GB) ..... 0206821.1

(51) Int. Cl.
*A47G 29/10* (2006.01)
*B67B 7/44* (2006.01)

(52) U.S. Cl. ..... 70/408; 70/456 R; 7/151; 81/3.55

(58) Field of Classification Search ..... 70/408, 70/395, 456 R, 457, 458, 459; 7/151; 81/3.55; 206/37.1, 38.1, 37.3, 37.4, 37.5, 37.8; D3/207, D3/208, 210
See application file for complete search history.

(56) References Cited

U.S. PATENT DOCUMENTS 34,096 A * 1/1862 Stephens ..... 248/155.5
42,445 A * 4/1864 Vaughan ..... 408/64
D34,096 S * 2/1901 Stephens ..... D8/18
706,911 A * 8/1902 Dunham ..... 7/151
D42,445 S * 4/1912 Vaughan ..... D8/18
1,338,181 A * 4/1920 Kalkbrenner ..... 40/634
1,516,028 A * 11/1924 Sleeper ..... 24/708.2
1,730,246 A * 10/1929 Salfisberg ..... 70/456 R
1,899,203 A * 2/1933 LaBreche ..... 7/151
2,086,378 A * 7/1937 Butler ..... 206/37.8
2,198,110 A * 4/1940 Fischer ..... 70/456 R
2,621,550 A * 12/1952 Bach ..... 81/3.57
2,633,734 A * 4/1953 Genovese ..... 70/456 R (Continued)

FOREIGN PATENT DOCUMENTS

GB 2 260 565 4/1993

*Primary Examiner*—Lloyd A. Gall
(74) *Attorney, Agent, or Firm*—Dickstein Shapiro LLP

(57) ABSTRACT

A tool for turning keys comprising a tool body having an elongate slot adapted to removably receive the head of a key. The tool has an aperture, by means of which a key ring is attached to the tool. The aperture may have a constriction to prevent the key ring sliding along its length, therefore preventing the key becoming accidentally engaged in the slot in someone's pocket. A second slot is provided, crossing the elongate slot and perpendicular to it, to accommodate the part of the key ring nearest to the key. In addition to its use to turn a key, the elongate slot may also be used to engage with the ring pull on a can, and the tool body used to lever the ring pull, opening the can.

20 Claims, 13 Drawing Sheets

U.S. PATENT DOCUMENTS 2,729,325 A * 1/1956 Nauman ..... 206/0.81
3,530,698 A * 9/1970 Clement ..... 70/457
3,587,260 A 6/1971 Tajiri
3,729,965 A * 5/1973 Gartner ..... 70/395
3,753,625 A * 8/1973 Fabrizio et al. ..... 408/239 R
4,297,863 A * 11/1981 Glock ..... 70/395
4,412,464 A * 11/1983 Cook ..... 81/3.09
4,576,839 A * 3/1986 Parren ..... 428/13
4,583,383 A 4/1986 Bosco et al.
4,976,172 A * 12/1990 Thomas et al. ..... 81/3.09
4,991,417 A * 2/1991 Grecco ..... 70/408
5,077,850 A * 1/1992 Brubaker ..... 7/151
5,231,733 A 8/1993 Dittman et al.
5,577,403 A 11/1996 Steeley
5,600,980 A 2/1997 Fabian
5,621,936 A 4/1997 Penaligon et al.
5,671,624 A 9/1997 Sivils
5,794,471 A * 8/1998 Rizzo ..... 70/456 R
6,164,102 A 12/2000 Gapco

* cited by examiner

TOOL FOR TURNING KEYS

BACKGROUND OF THE INVENTION

1. Field of the Invention

The present invention relates to a tool for turning keys.

2. Description of the Related Art

Numerous people find it difficult to turn a key in a lock. This can be because a person suffers from a lack of dexterity, e.g. because of arthritis, or because the lock itself is stiff, e.g. due to warping of the door or frame.

Most keys have a key shank which is inserted into the lock and a key head in the form of a plate which can be gripped by the fingers. The key head is not normally particularly wide which makes it difficult for some people to grip and it does not provide much mechanical advantage in tuning the key shank.

It is known to provide a key turner which is somewhat similar to a pen knife in that, instead of a blade, a key is hinged to rotate in and out of a slot in turner body, with the turner body acting as a handle to rotate the key when it is hinged out of the body. Such key turners often support two keys and are somewhat large and unsightly and are only designed for certain shapes of keys. Also, they can only be used with the keys to which they are hinged, and do not allow keys rings to be fitted to the keys to support other items.

The invention seeks to provide a tool to enable keys to be turned more easily.

People with arthritis or with a lack of dexterity in addition are likely to face a problem with operating the ring pulls on cans. Also, people who are concerned with damaging their fingernails or fake nail attachments may have difficulty with operating ring pulls. Damage, scratches or chipping is deemed as painful, problematic and costly. This is particularly true if nail attachments need to be replaced. In the cold it can be difficult for people to operate ring pulls without talking off their gloves, e.g. during winter sports. This is inconvenient.

Most modern ring pulls remain either attached to the can (soft drinks) or to the top removable face of the container (cat food or sardine can). The ring pull has a flat body that is riveted to the container and acts as a lever with the rivet acting as the fulcrum. The flat body is not normally particularly long or wide which makes it difficult for some people to apply the necessary effort. It does not provide a suitable mechanical advantage ratio between load needed to open the container and the effort input.

It is known to provide a ring pull for cans which is a steel loop that has a rod extension with a hooked end. The loop handle is large enough for all four fingers to fit through so that the hooked end extension can be located under the ring pull and levered up. Such ring pulls for cans require good coordination to locate properly on the can and are somewhat large and unsightly and are unlikely to be carried "on person". For cans that retain the ring pull (soft drinks), they only aid part of the normal process as the device is unable to push back the opened ring pull into, for example, the drinking position. This has to be done manually.

The tool of the invention may further be adapted for opening cans by levering ring pulls. The invention has two different processes for opening the two forms of ring pull container.

The present invention provides a tool for turning keys comprising a tool body having an elongate slot adapted to removably receive the head of a key. In one embodiment the tool body has an aperture at one end carrying a key ring. The tool body may also have a second slot substantially normal to and crossing said elongate slot whereby a first point on the key ring can rotate about said aperture such that a second opposing point on the key ring can engage into said second slot with a key head carried on said opposing point also engaging said elongate slot. The second slot is spaced from the aperture by a minimum distance equal to two opposing points on the key ring and can be straight or curved or any other shape that serves its function.

For example, the slot can be configured into a hook shape so that the second slot can function as a hooked lever for opening ring pull containers where the lid needs to be peeled off. Another alteration of the slot is its modification into a bottle top opener that can lever off crimped tops on such containers as beer bottles.

The aperture for the key ring may be an elongate aperture, or a large void of any shape to decrease the units weight and material costs. The aperture may also be aesthetically pleasing for example the shape of a heart a star or an animal etc. The aperture may be located near the edge of the body, so that the key ring can easily be threaded on.

The tool may be lightweight, and approximately the same length as a deadlock key. The tool body may be a unitary construction, but might require a stronger composite construction when used for crimped bottle tops. The tool body may also be adapted for use as a lever, to aid the opening of ring pulls on cans.

BRIEF DESCRIPTION OF THE DRAWINGS

Embodiments of the invention will now be described with reference to the accompanying drawings, in which.

DETAILED DESCRIPTION OF THE PREFERRED EMBODIMENTS

In a first embodiment of the invention the tool body has elongate rectangular faces spaced by two longer and two shorter side walls, said elongate slot being provided in one longer side wall adjacent one corner of the tool body. The elongate slot may also extend through one shorter side wall adjacent the longer side wall. The elongate slot may include one or more inner steps to accommodate the thicker shaft found on a standard deadlock key.

Figure 1:
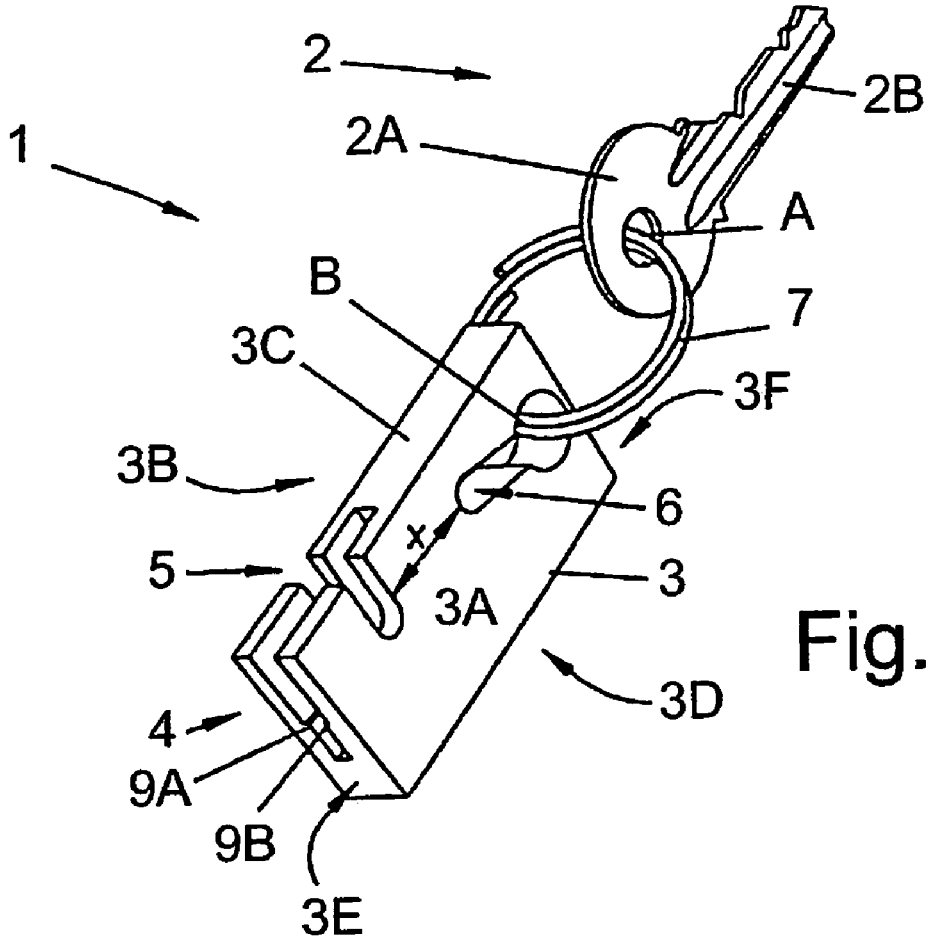
FIG. 1 shows a perspective view of a first embodiment of the invention, showing a key attached to a key ring with a tool thereon prior to use of the tool.

Referring to FIG. 1 there is shown a tool 1 for turning a key 2. Toot 1 comprises a tool body 3 having an elongate slot 4 adapted to receive the head 2A of the key.

Tool body 3 is formed as a unitary construction moulded from plastics. Tool body 3 has elongate rectangular faces 3A, 3B spaced by two longer and two shorter side walls 3C, 3D and 3E, 3F respectively. The elongate slot 4 is provided in longer side wall 3C adjacent one corner of the tool body and also extends through shorter side wall 3E adjacent the longer side wall.

Tool body 3 has a second slot 5 normal to and crossing the elongate slot 4. Slot 5 extends inwards from longer side wall 3C.

Tool body 3 also has an elongate aperture 6 at one end carrying a key ring 7. The second slot 5 is spaced from the elongate aperture by a distance X which is equal to the distance of two opposing first and second points A, B on the key ring or, because the key ring shown is circular, the diameter of the key ring.

The wall thickness of the body 3 between the end of elongate aperture 6 and side wall 3F is narrow to allow the key ring to be easily threaded into the aperture.

Figure 2:
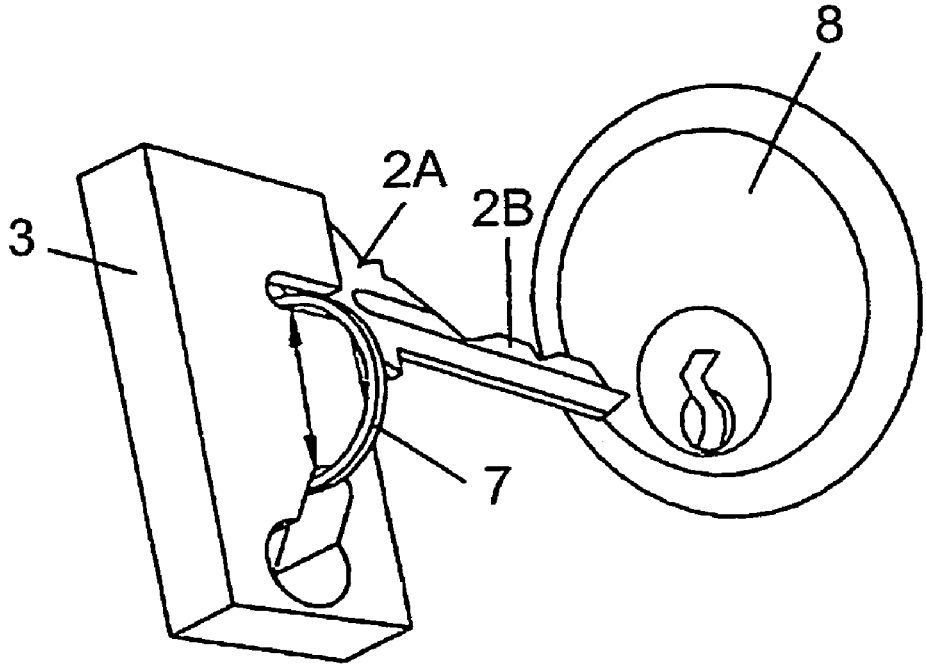
FIG. 2 shows a perspective view of the tool of the first embodiment of the invention in use with a key.

As shown in FIG. 2, when it is desired to turn the key 2, first point B on the key ring 7 can rotate in the aperture 6 such that the second point A on the key zing 7 can engage into the second slot 5 with a key head 2A carried on the second point A also engaging the elongate slot 4.

Key 2 can then be turned using tool 1 as a lever to rotate the key 2 when the key shank 2B is inserted into lock 8.

In use of the invention shown in the drawings, it may be preferred to first insert the key 2 in the lock with the tool 1 dangling below the key 2 on the key ring 7 as shown in FIG. 1. The tool 1 is then raised and rotated manually so that the key head 2A enters the elongate slot 4 as shown in FIG. 2.

The elongate slot 4 may include one or more inner steps 9A, 9B to accommodate different widths of key shanks, e.g. to accommodate latch type keys as shown or mortise lock keys with a wider shank. Chubb type keys with smaller shanks will be prevented from sliding in too far.

It will be appreciated that the elongate aperture 6 allows the body 3 to have sufficient length to give a good mechanical advantage whilst rotating the key 2, yet it also allows the provision of a narrow section between the elongate aperture 6 and side wall 3F to thread a key ring easily through the slot.

It will be appreciated that a number of keys could be held on the key ring 7, and each separately can be located in slot 4 when it is desired to turn one in a lock.

The invention may take a form other than that specifically described. For example the key ring 7 could be other than circular. Indeed the tool 1 need not be adapted to take a key ring 7 but could be used on its own to rotate a key 2. Alternatively, the key ring 7 could be replaced by a loop or a chain or a cord. There could be a separate chain or cord for each key, or the chain or cord could be attached to a key ring containing one or more keys.

The tool body could be other than rectangular in shape. The body could be plastic or metal. It could be graphite impregnated plastic e.g. a graphite composite impregnated with fibreglass for extra strength. Preferably, the key fob is made by injection moulding using ABS plastic.

Figure 3:
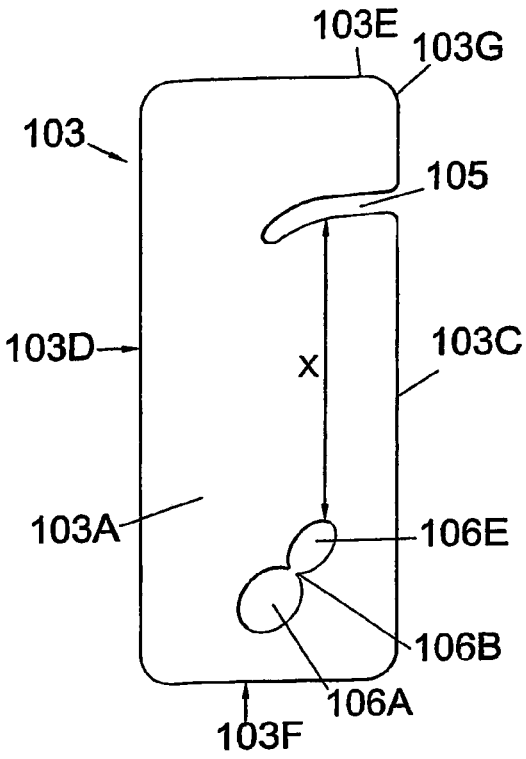
FIG. 3 shows a side view of a second embodiment of the invention.
Figure 4:
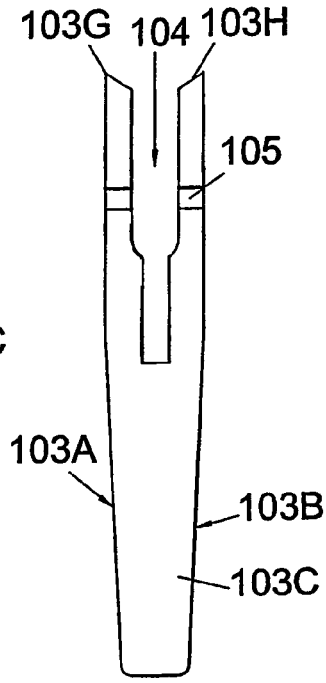
FIG. 4 shows an edge view of the second embodiment of the invention.
Figure 5:
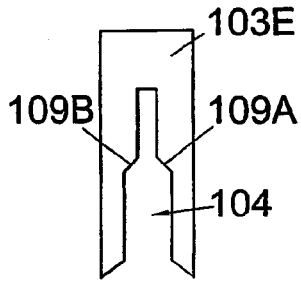
FIG. 5 shows a top view of a second embodiment of the invention.

Further modifications will be apparent to those skilled in the art without departing from the scope of the present invention FIGS. 3, 4 and 5 show a side view, an edge view and a top view respectively of a second embodiment of the invention. The faces 103A and 103B are tapered such that the tool narrows towards the end with the aperture 106, to allow keys 102 to lie next to the tool 101 without being pushed out. This also has the advantage of taking up less room on the key fob. The faces may be patterned to aid grip.

Figure 6:
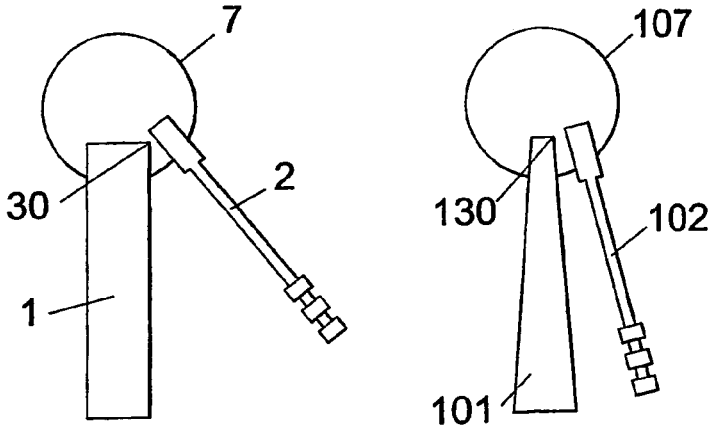
FIG. 6 shows a comparison between a block shaped key fob and a tapered key fob.

FIG. 6 shows a comparison between a rectangular key fob 1, which pushes the keys outwards in an awkward and inconvenient way, and a tapered key fob 101, e.g. as shown in the second embodiment of the invention. It is the corner 30, 130 which pushes out the key 2, 102 and this effect is greatly reduced in the embodiment with the tapered faces.

In the second embodiment of the invention, a few other advantageous features are also shown. The steps 109A, 109B inside the elongate slot 104 are chamfered instead being at right angles to the inner faces of the elongate slot 104. When the tool is used to open a ring pull on a can, this allows the ring pull to slide over the step without getting stuck in the corner. The edges of the elongate slot 104 are tapered, to make it easier to slide the tool underneath a ring pull, in order to locate the ring pool in the elongate slot 104.

Figure 7:
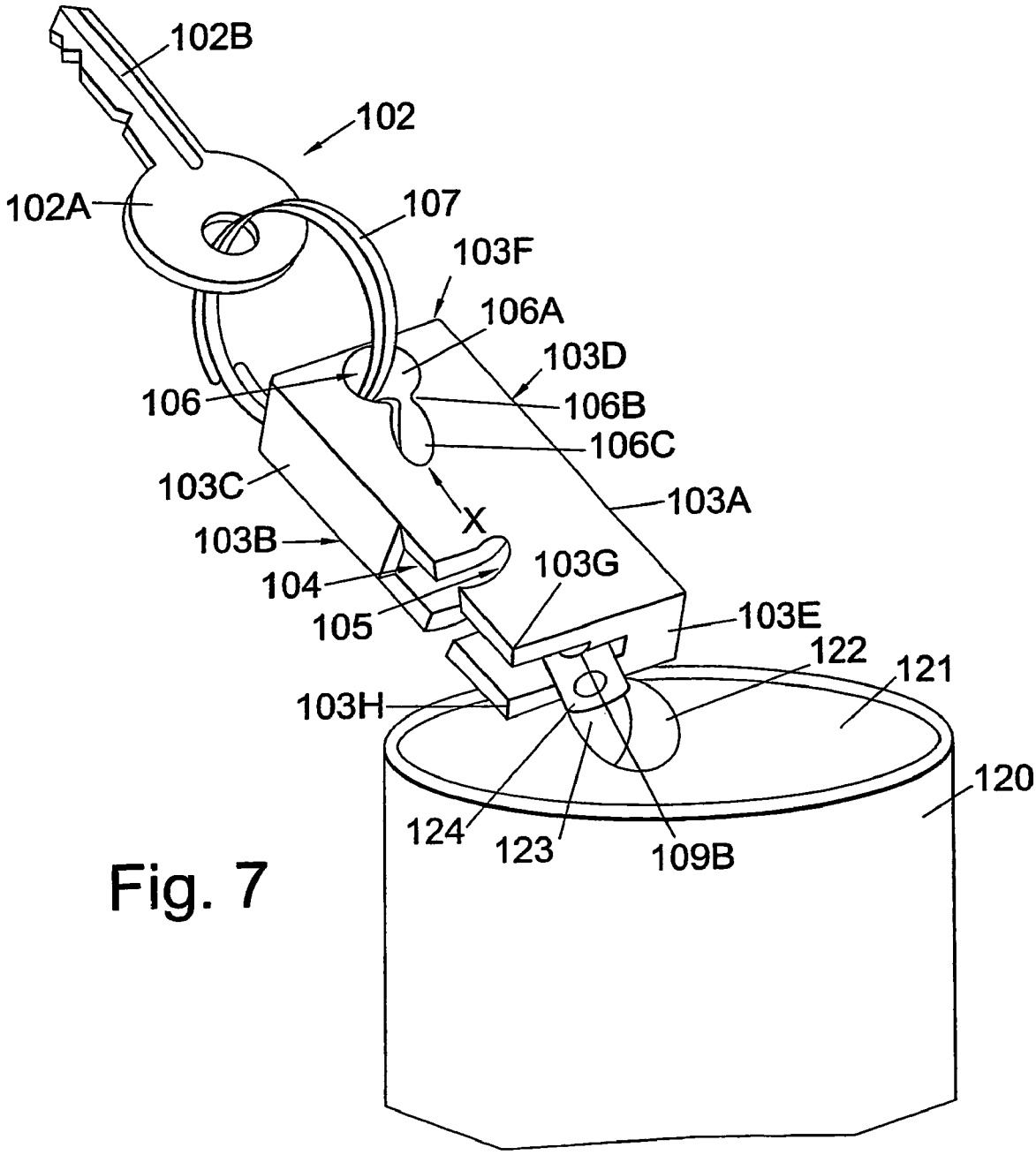
FIG. 7 shows a tool according to the second embodiment of the invention when in use with a ring pull.

FIG. 7 shows a tool according to the second embodiment of the invention, when in use to operate a ring pull 124 of a can 120 on a top 121 of the can 120. The ring pull 124 is received in the elongate slot 104 of the tool body 103.

When it is desired to lever the ring pull 124, first contact to the underside of ring pull 124 is made with either tapered corner 103G or 103H, or with a tapered edge of the elongate slot 104. The ring pull 124 may be received in the elongate slot 104 via the end face 103E or the side face 103C of the tool. However, receiving it via the end face 103E will allow a higher degree of leverage, due to the greater length of the tool normal to the end face 103E. The ring pull 124 can then be levered upwards using the tool as an extension of the ring pull 124. When the tab 123 of the ring pull 124 is opened to provide a sufficient opening 122 the tool can be used to move the ring pull 124 to its original position.

The second slot 105 is curved to follow the path subtended by the key ring 107 as it is rotated around the aperture 106. This ensures that the key ring 107 will not become too tight as it is pushed further into the second slot.

It is also be possible to alter the curvature of the second slot 105 so that the key ring 107 has a tight fit against the second slot 105 as it is initially inserted, but a looser fit once it is inside the second slot 105.

A potential problem with the key turning tool is that a key 102 may become accidentally engaged in the elongate slot 104 inside the pocket of the user. It may then stab into the user's body. To prevent the key ring 107 sliding into the elongate slot 104 and the key 102 becoming accidentally engaged in the elongate slot 104 in someone's pocket, the aperture 106 has a constriction 106D which prevents the key ring 107 from being moved from one end of the aperture 106A to the other end 106C without a small force being applied. This is illustrated in FIG. 3 and in FIG. 7. This helps to keep the key ring 107 in the part 106A of the aperture 106 furthest from the second slot 105 when the tool is in someone's pocket. The force could easily be applied when a key 102 is in the lock, by turning the tool body 103 so that the aperture 106 is at the bottom, then pushing downwards on the tool body 103 against the key ring 107.

Figure 8:
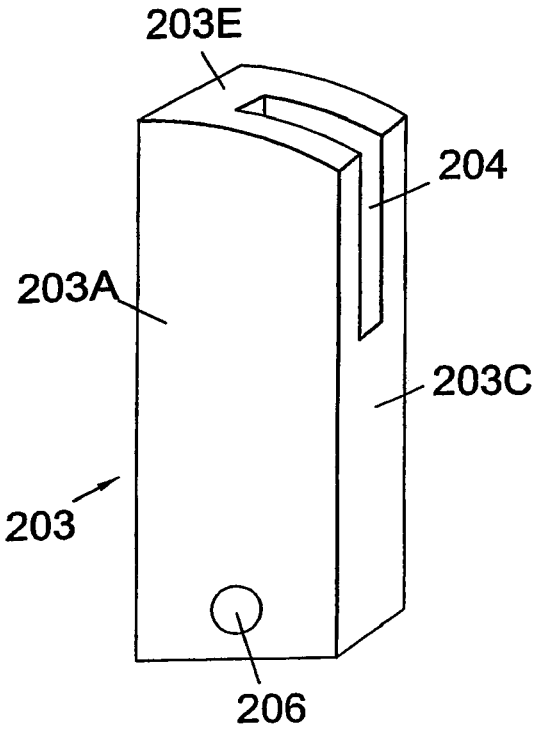
FIG. 8 shows a perspective view of a third embodiment of the invention, having a curved upper surface.

A further solution to this problem in another embodiment of the present invention is to have a key ring or loop which requires flexing to reach the slot. The key ring 107 could be made of a metal which when slightly stretched, attempts to revert back to its original shape. It would then be possible to have the diameter of the key ring slightly smaller than the distance X between the second slot 105 and the part of the aperture 106C nearest to the second slot 105. When the device is used with a lock, a weak downward force on the tool could be enough to warp the key ring, increasing its internal diameter to distance x, and allowing it to fit into the second slot 105. As this would be very unlikely to happen accidentally in someone's pocket, the problem of the key unintentionally becoming engaged in the slot would be avoided. Similarly, it would also be possible to have the diameter of the key ring slightly larger than the distance X, such that the key ring had to be compressed slightly in order to fit into the slot FIG. 8 shows a tool having an elongate aperture 204 and a curved upper face 203E, to allow a key ring to pivot over the top of the upper face 203E. The curved face 203E is at an opposed end of the tool body 203 to an aperture 206 for receiving a key ring. There is no need for a second slot in this embodiment.

Figure 9:
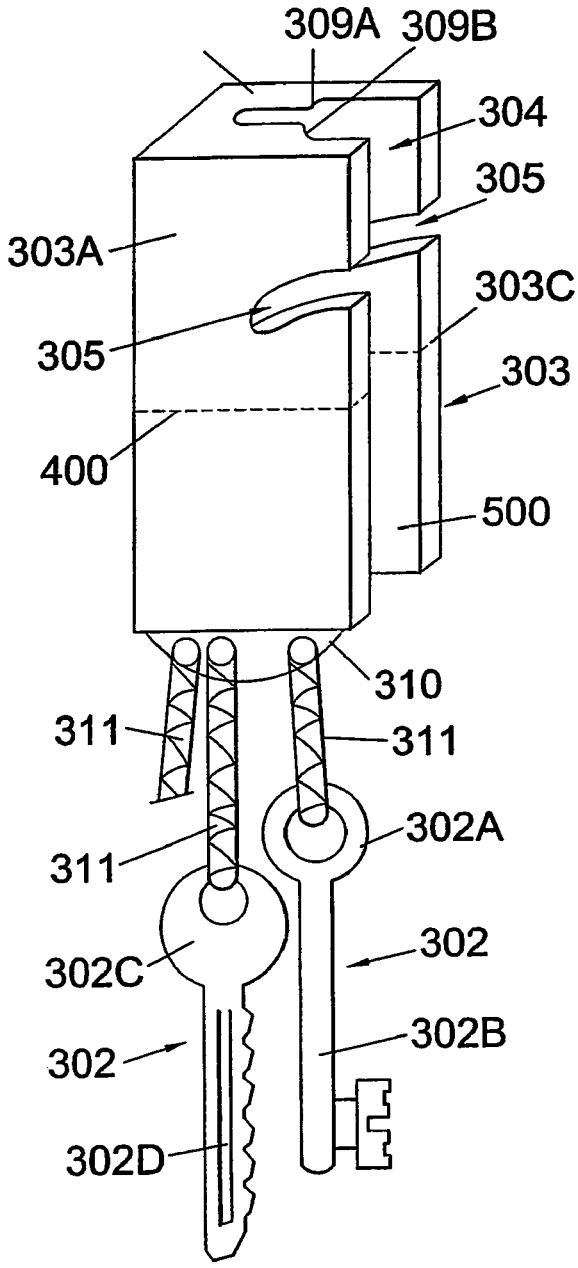
FIG. 9 shows a fourth embodiment of the invention, having a plurality of keys attached by chains.
Figure 10:
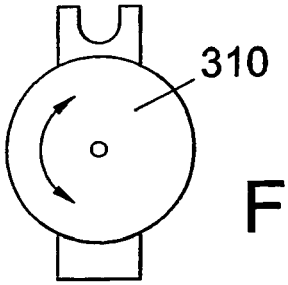
FIG. 10 shows a bottom view of the fourth embodiment of the invention, with a rotatable turntable to which the keys are attached.

FIG. 9 shows a fourth embodiment of the invention. The aperture and key ring are replaced by a turntable 310 and a cord or chain 311 for each key 302. The turntable 310 is rotatable on the tool body 303 to allow the relevant key 302 to be positioned nearest to the elongate slot 304. The second slot 305 allows the cord or chain to be accommodated in the tool body on either side of the key. Along the side 303C there is provided a recess 500 along which the chain 311 will lie when the key 302 is engaged in the slot 304. FIG. 10 shows a bottom view of the fourth embodiment, in which the turntable 310 can clearly be seen.

Figure 11A:
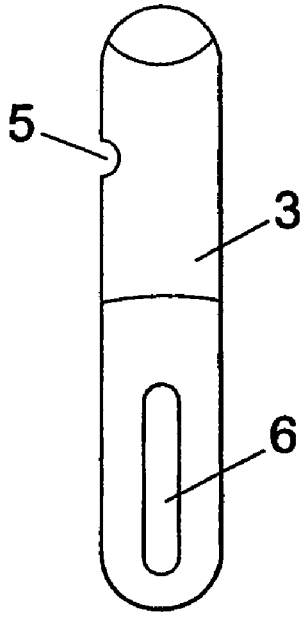
FIGS. 11*a* to 11*c* show a modification of the first embodiment, with the width of the tool reduced.
Figure 11B:
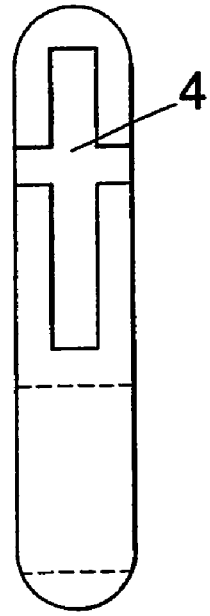
Figure 11C:
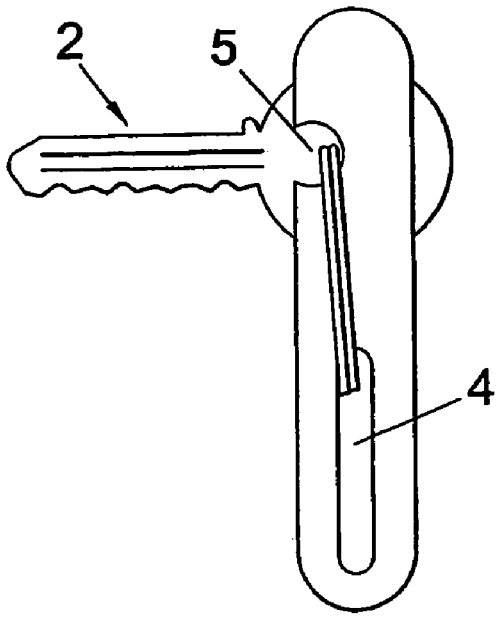

FIG. 11 shows a modification of the first embodiment with the width of faces 3*a* and 3*b* reduced. The elongate slot 4 transverses from 3*c* to 3*d*. Slot 5 is condensed into a semi circle. Alternatively, slot 5 may not be present at all, the two faces 3*a*, 3*b* simply engaging the key ring 7.

Figure 12:
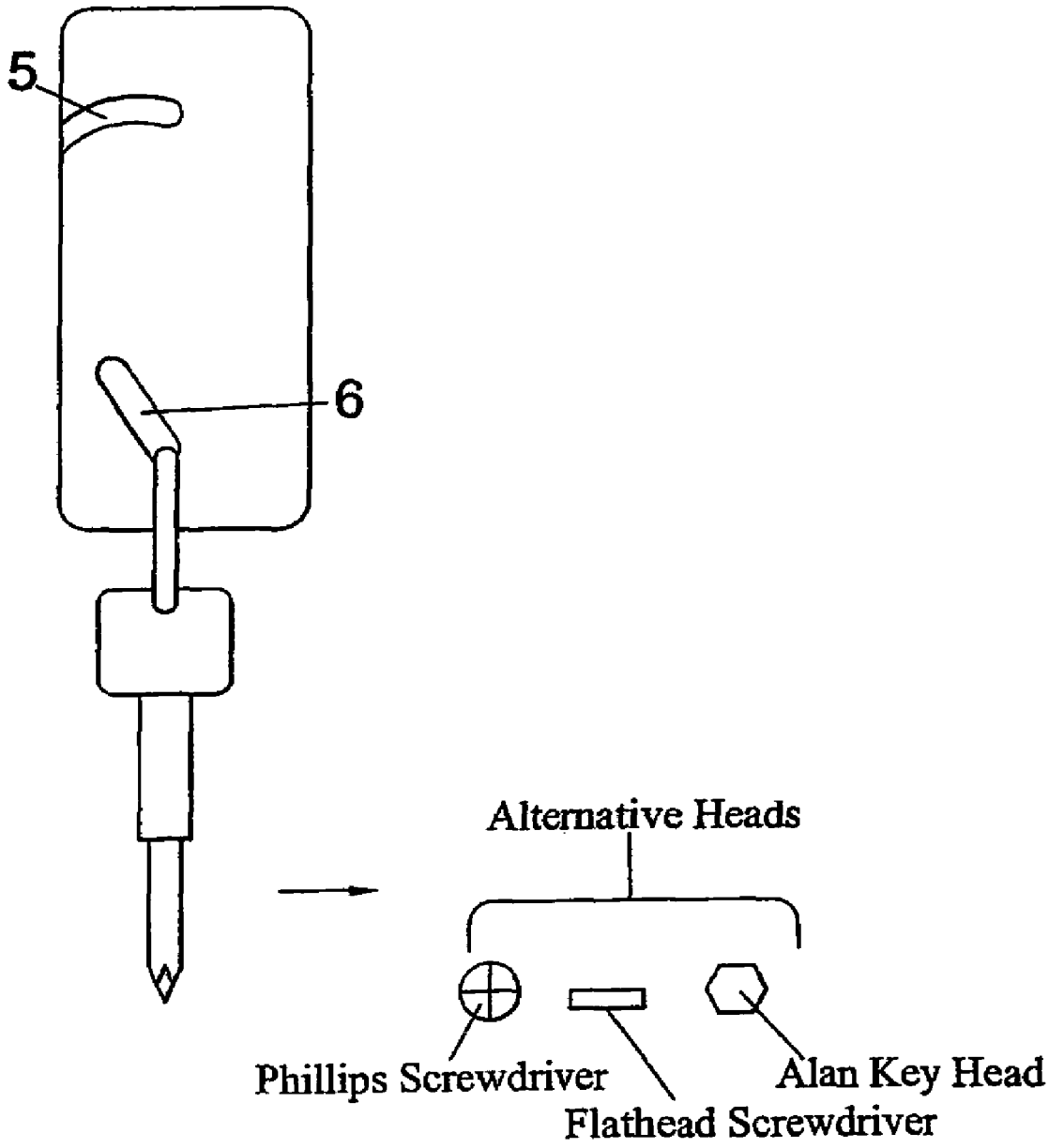
FIG. 12 shows a variation of the first embodiment in which an adapted dead lock key system where the lock end has been replaced by shafts of different tools, for example screwdriver heads or Allan keys.
Figure 13A:
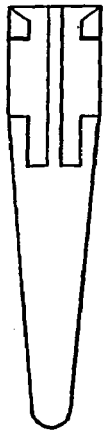
FIGS. 13*a* to 13*d* show a fifth embodiment of the invention where the slot is adapted into a ring pull hook that can be used to open drink cans.
Figure 13B:
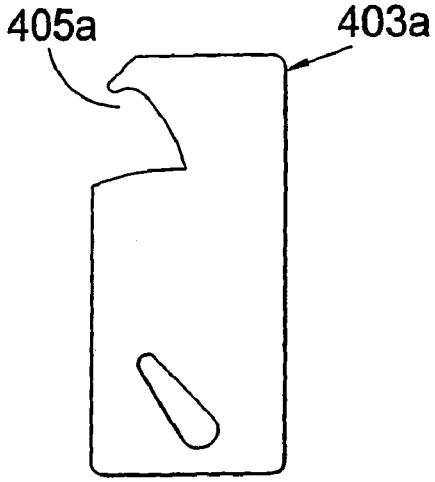
Figure 13C:
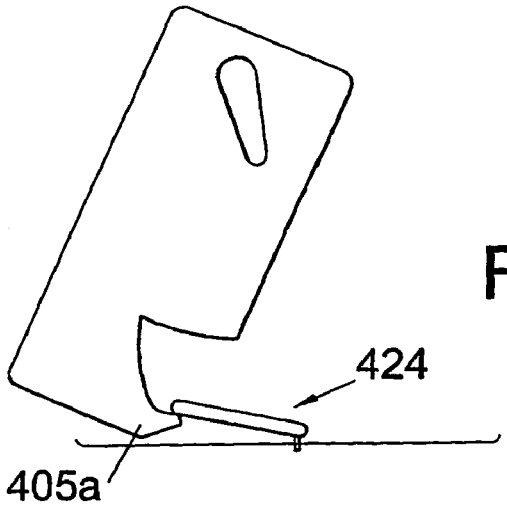
Figure 13D:
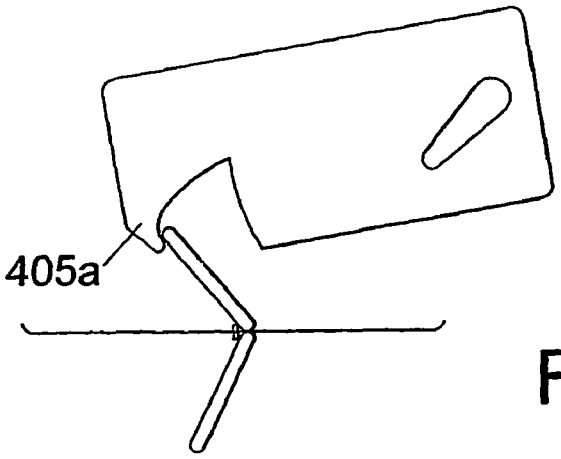
Figure 14A:
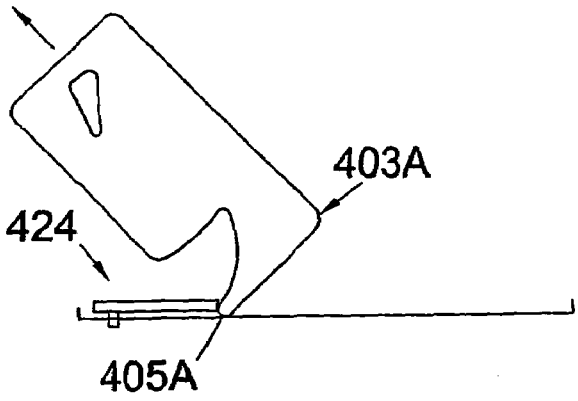
FIGS. 14*a* to 14*d* show the fifth embodiment in use with a ring pull container requiring the removal of the entire can top e.g. sardine can.
Figure 14B:
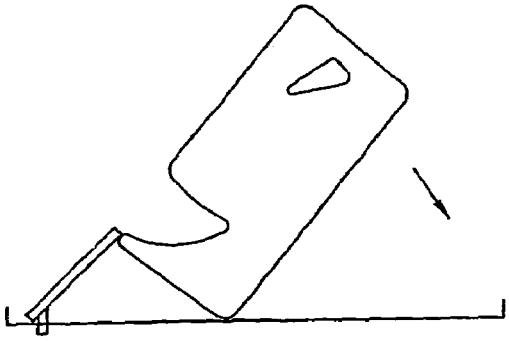
Figure 14C:
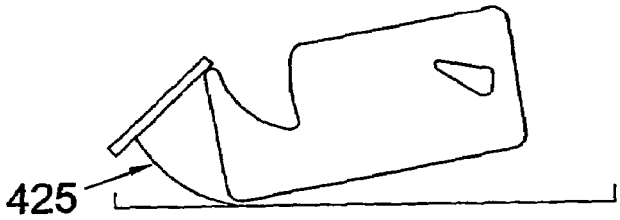
Figure 14D:
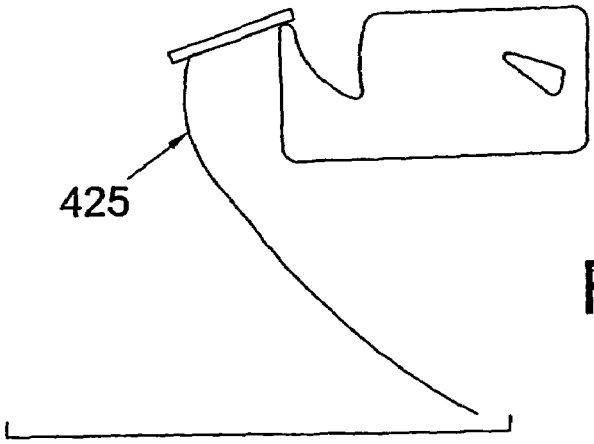

FIG. 12 shows a variation of the first embodiment, where tool 3 can be used as a lever for different application heads attached to a modified key 2. This enables rapid exchange of different tool heads and reduces the volume of tools as only one handle is required for many tool heads. The heads may be Allan key heads or screwdriver heads or the like.

FIG. 13 shows a fifth embodiment of the invention. In this embodiment slot 405 is modified so that its head is formed into a hook 405*a* FIGS. 13*c* and 13*d* show how hook 405*a* can be used to lever the ring pull 424 upwards and open the can.

FIG. 14 shows a use of the fifth embodiment. A hook 405*a* open a peel off ring pull lid 425. The hook 405*a* is inverted and slid under the ring pull 424 of a can. Peel off lid 425 is levered open using tool face 403*a*. Once opened sufficiently peel off lid 425 is pulled off.

Figure 15:
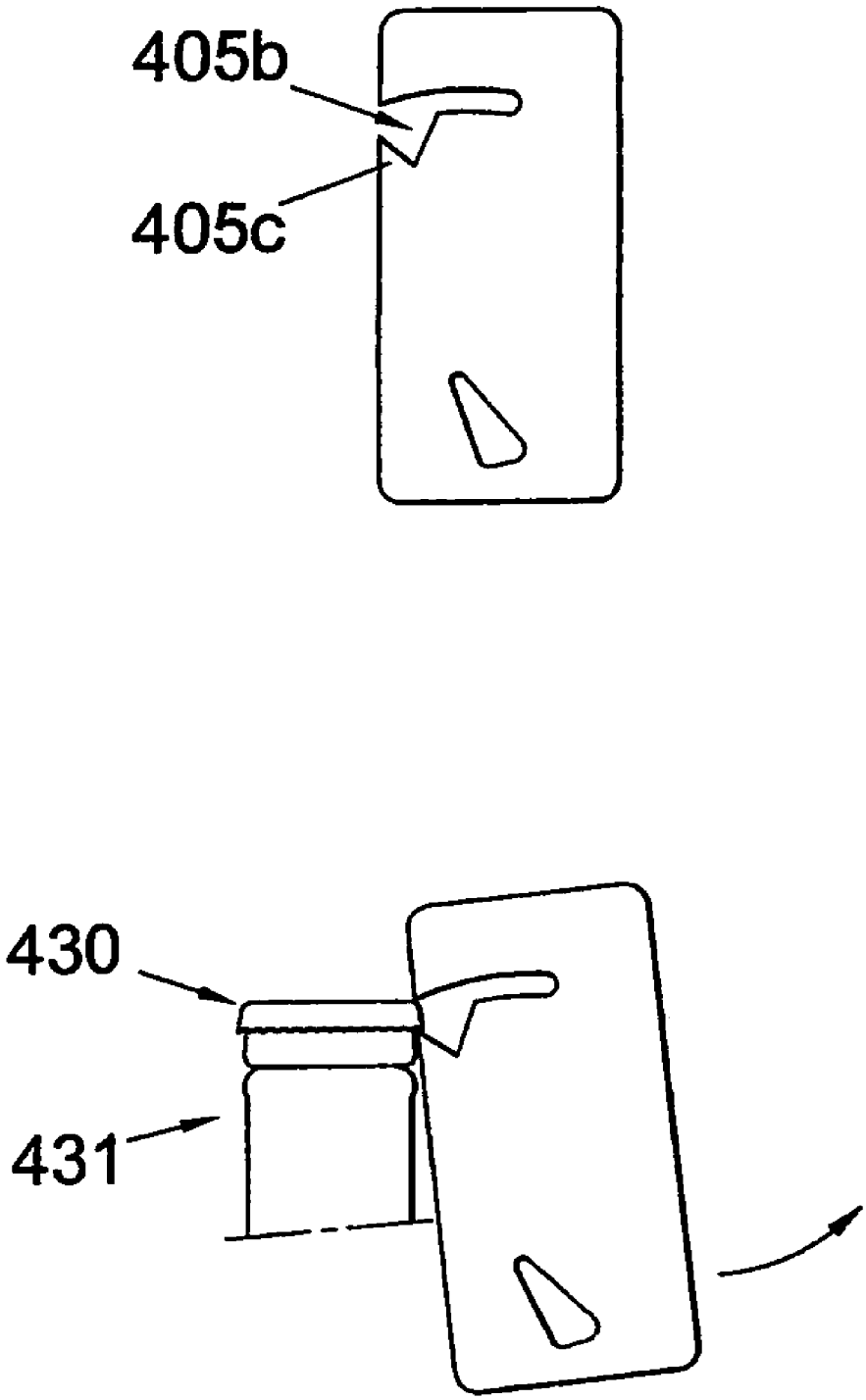
FIG. 15 shows an adaptation of the fifth embodiment in which the slot can remove crimped bottle tops, e.g. beer bottles.

FIG. 15 shows a modification to the fifth embodiment. The slot 405*b* is modified from the slot of the fifth embodiment so that it can accept a bottle top 430. The slot 405*b* has a trench 405*c* that grips the crimped cap 430. Pulling tool 403 up and away from the bottle 431 removes bottle top 430.

Figure 16:
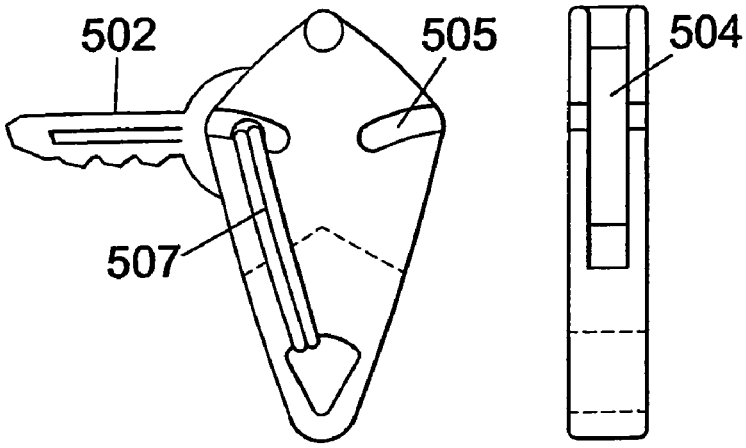
FIG. 16 shows a sixth embodiment of the device having a dual symmetry that can accommodate two key rings.

FIG. 16 shows a sixth embodiment in which a bi-symmetrical design is employed. This enables twice the capacity of keys 502 to be carried on two key rings 507.

Figure 17:
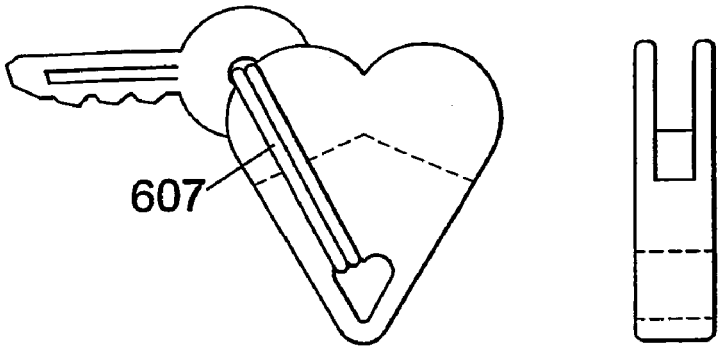
FIG. 17 shows a seventh embodiment with an alternative symmetry design.
Figure 18:
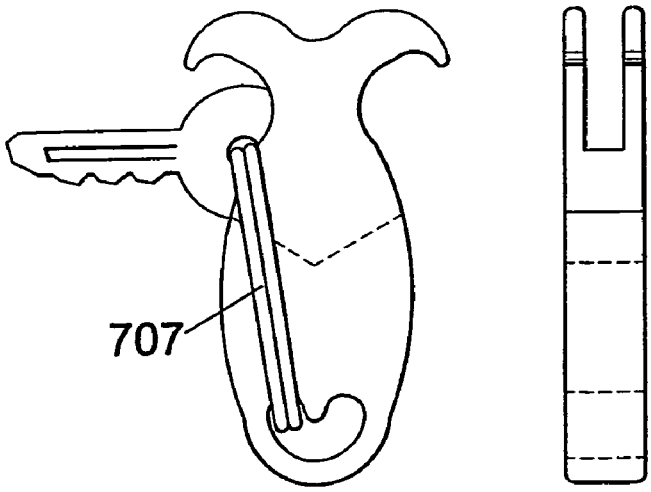
FIG. 18 shows an eighth embodiment with an alternative symmetry design.

FIGS. 17 and 18 show seventh and eighth embodiments in which different bi-symmetrical designs are employed. In the seventh and eighth embodiments the shapes are a heart and a fish, but other suitable shapes could also be used.

Figure 19A:
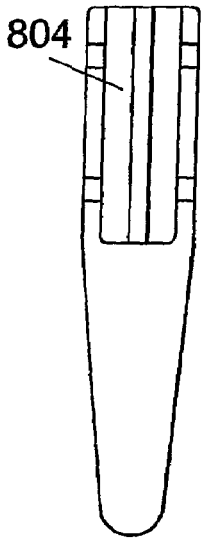
FIGS. 19*a* and 19*b* show a ninth embodiment with an alternative ring pull design.
Figure 19B:
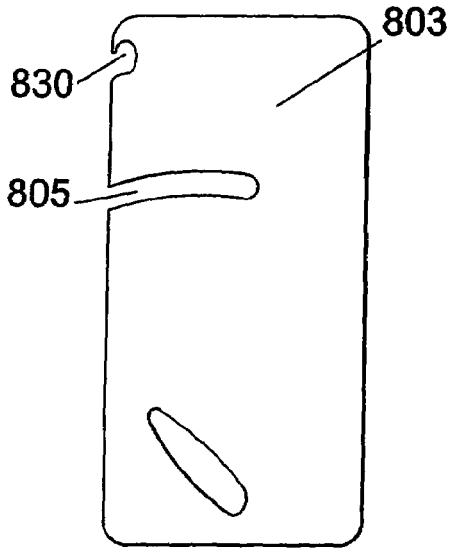

FIG. 19 shows a ninth embodiment of the invention. The ninth embodiment differs from the fifth embodiment in that a separate notch 830 is provided for opening cans in addition to slot 805. This strengthens the structure of the embodiments of FIGS. 13 and 14. The ninth embodiment differs from the embodiment of FIGS. 13 and 14 by the addition of the new notch 830, with the same orientation as slot 105, that can hook a ring pull 124. However, this embodiment functions in the same manner as the embodiment of FIGS. 13 and 14.

Figure 20A:
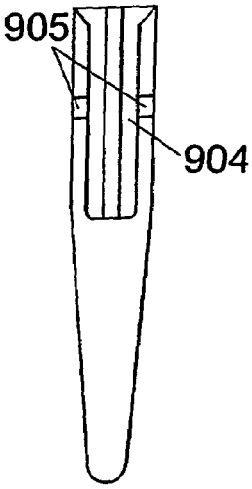
FIGS. 20*a* to 20*c* show a tenth embodiment with the elongate slot having no inner steps. Instead, the faces are angled with respect to the elongate faces of the tool.
Figure 20B:
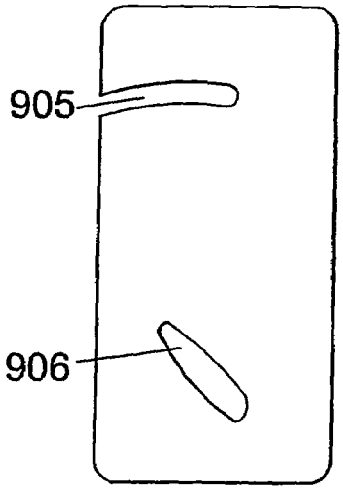
Figure 20C:
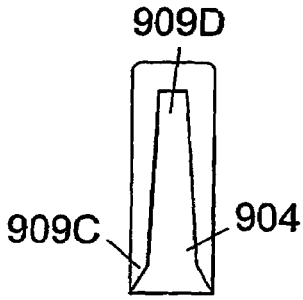

FIG. 20 shows a tenth embodiment in which, instead of inner steps 9A and 9B (FIG. 1), the sides of slot 904 can be angled such that the internal separation of the sides is greatest at 909C. This will enable the device to fit all keys without the complications of extraction that inner steps cause from injection moulding machines.

Figure 21A:
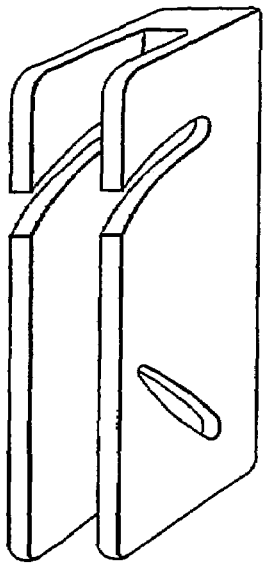
FIGS. 21*a*, 21*b* and 21*c* show a variation of the first embodiment in which the elongate slot runs the entirety of the side of the tool.
Figure 21B:
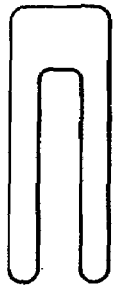
Figure 21C:
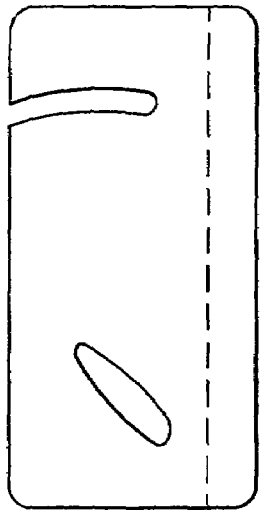

FIG. 21 shows slot 4 running from face 3E to 3F. In this instance there is no requirement for distance X and any key ring 7 can be attached and used by the device.

Figure 22:
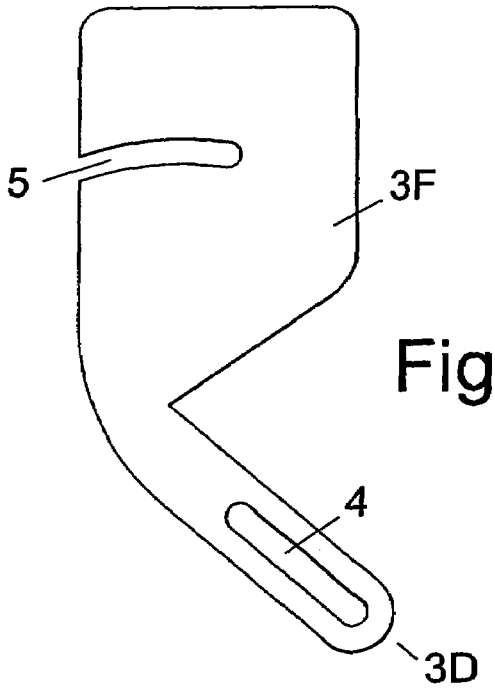
FIG. 22 shows a variation of the first embodiment in which parts of the body have been removed to reduce material requirements.

FIG. 22 shows a variation on the first embodiment. Faces 3A and 3B (FIG. 1) have been cut away to form a triangular cut out between 3D and 3F, and a further triangular cut out of the corner joining 3C and 3F (FIG. 1), so that only the functional parts exist. This makes the device cheaper and more lightweight.

Figure 23A:
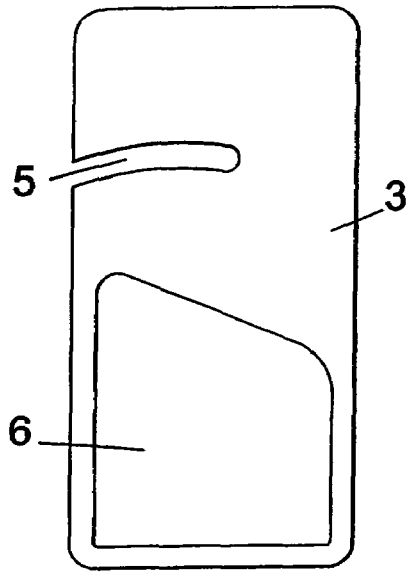
FIGS. 23*a* and 23*b* show a further variation of different configurations for the key ring elongate aperture.
Figure 23B:
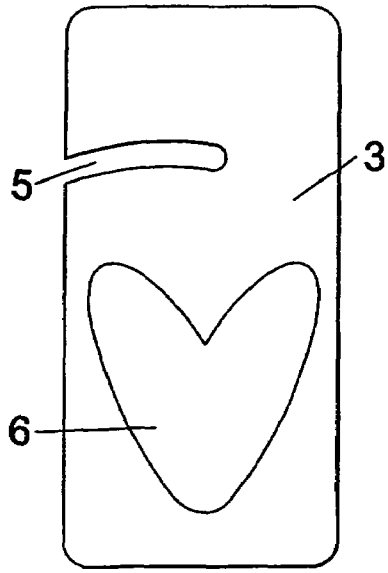

FIG. 23 shows a further variation of the first embodiment, wherein the elongate aperture 6 comprises a large void. This embodiment retains the functionality of the device but reduces weight and manufacturing cost. Various cut out shapes can be employed.

Figure 24A:
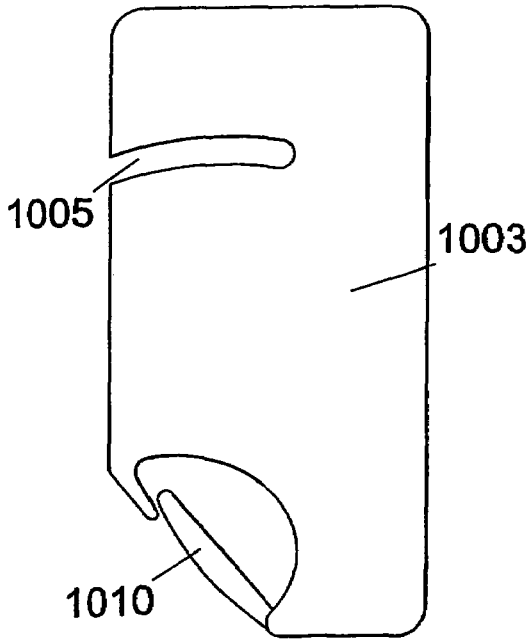
FIGS. 24*a* and 24*b* show an eleventh embodiment of the invention in which a quick release system is employed for removal and attachment of keying to device.
Figure 24B:
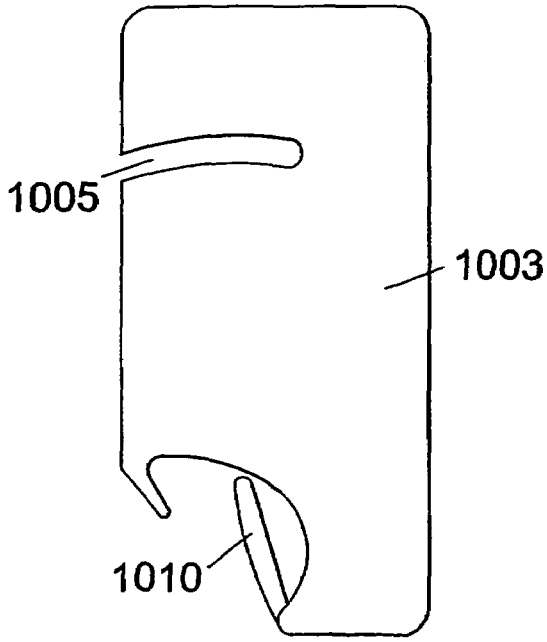

FIG. 24 shows an eleventh embodiment in which tool body 1003 comprises a spring attachment 1010. The spring metal when pressed inwards towards the body 1003 enables a gap to be generated which enables the keying to be removed or attached.

The key fob of any of the previously described embodiments may be provided with a line of weakness across its body, so that if an excessive force is applied, the key fob will break along this line of weakness before the key itself becomes damaged. This is indicated by line 400 in the embodiment of FIG. 9. This avoids over-stressing the key. A good place to locate the fault line is at the base of the slot 304, the fault line could be arranged inside the slot 304 so as not to affect the aesthetic qualities of the device.

The invention may take a form other than that specifically described. For example, the elongate slot could transverse the two shorter side walls 3C, 3D. The tool body could also be other than rectangular in shape. It is possible that individual features from various embodiments be combined or exchanged in ways other than explicitly referenced herein, and the invention also extends to any such combinations or exchanges of features.

It will be appreciated that several version of ring pulls exist. The device is functional for all forms of ring pull container and crimped bottle tops.

In one embodiment of the present invention the internal corners of the slot 4 and 304 can be rounded for improved strength.

Although the present invention is suited for use with keys to which the device is feasibly attached, the device can of course be used with separate unattached keys.

The invention claimed is:

1. A tool for turning keys comprising:

a tool body having an elongate slot adapted to removably receive the head of a key, a second slot in said tool body adjoining said elongate slot, and an aperture; and a loop attached to said tool body via said aperture and also attachable to said key, providing a flexible coupling of said tool body and said key;

wherein said loop is sized such that the distance between first and second opposing points on said loop is substantially equal to the distance between said second slot and said aperture, such that said loop can be rotated about said first opposing point inside said aperture to engage said second opposing point on said loop into said second slot, so as to engage a key head carried on said second opposing point within said elongate slot.

2. A tool as claimed in claim 1, wherein said second slot is perpendicular to said elongate slot.

3. A tool as claimed in claim 1, wherein said elongate slot is located at a first end of the tool body.

4. A tool as claimed in claim 1, wherein said tool body has a first face, and a second face adjoining the first face, and said elongate slot is located in both the first and second faces of the tool body.

5. A tool as claimed in claim 1, wherein said loop comprises one of the group consisting of: a cord; a chain; a key ring and a clip.

6. A tool as claimed in claim 1, wherein the distance between the second slot and the aperture is slightly greater than or slightly less than the distance between opposing points on the loop, and the loop is elastically deformable to the extent that it can be engaged in the second slot when deformed.

7. A tool as claimed in claim 1, wherein said tool body is elongate and has a tapered shape, being thinnest at an end nearest to the aperture.

8. A tool as claimed in claim 1 wherein said aperture is elongate.

9. A tool as claimed in claim 1, wherein said aperture is keyhole shaped, such that said aperture comprises a substantially circular portion and a narrower portion.

10. A tool as claimed in claim 1, wherein said aperture is located proximate to an edge of said tool body.

11. A tool as claimed in claim 1, wherein said aperture has a first end, a second end, and a constriction between the two ends, said constriction narrowing the aperture between the two ends.

12. A tool as claimed in any claim 1, wherein said loop is adapted for flexibly coupling said tool body and a plurality of keys.

13. A tool as claimed in claim 12 comprising a plurality of cords or chains for attaching a plurality of keys to the tool body.

14. A tool as claimed in claim 1, wherein said elongate slot is deeper than said second slot.

15. A tool as claimed in claim 1, wherein the second slot is curved.

16. A tool as claimed in claim 1, wherein said elongate slot is of a size and shape suitable for accommodating the pull tab of a ring pull.

17. A tool as claimed in claim 1, wherein said elongate slot has a step inside which divides said elongate slot into a wide part and a deeper narrow part.

18. A tool as claimed in claim 17 wherein said step is chamfered towards the narrow part of the slot.

19. A tool, as claimed in claim 1, wherein a region of a face of the tool body surrounding the elongate slot slopes inwards towards the elongate slot.

20. A tool as claimed in claim 1, wherein said tool body has a line of weakness such that the tool will break if it is used to apply an excessive force to a key.

* * * * *